US010354564B2

(12) United States Patent
Topousis et al.

(10) Patent No.: US 10,354,564 B2
(45) Date of Patent: Jul. 16, 2019

(54) MODULAR DISPLAY

(71) Applicant: JOHN RYAN PERFORMANCE, INC., Minneapolis, MN (US)

(72) Inventors: Alex Topousis, Maple Plain, MN (US); Nancy Radermecher, Woodland, MN (US)

(73) Assignee: John Ryan Performance, Inc., Minneapolis, MN (US)

( * ) Notice: Subject to any disclaimer, the term of this patent is extended or adjusted under 35 U.S.C. 154(b) by 23 days.

(21) Appl. No.: 15/609,600

(22) Filed: May 31, 2017

(65) Prior Publication Data

US 2017/0345350 A1 Nov. 30, 2017

Related U.S. Application Data

(60) Provisional application No. 62/343,719, filed on May 31, 2016.

(51) Int. Cl.

| | |
|---|---|
| ***G09F 15/00*** | (2006.01) |
| ***G09F 7/18*** | (2006.01) |
| ***G09F 9/302*** | (2006.01) |

(52) U.S. Cl.

CPC ..... *G09F 15/0018* (2013.01); *G09F 7/18* (2013.01); *G09F 9/3026* (2013.01); *G09F 2007/1847* (2013.01); *G09F 2007/1891* (2013.01)

(58) Field of Classification Search

CPC ..... G09F 15/0018; G09F 7/18; G09F 9/3026; G09F 2007/1847; G09F 2007/1891

See application file for complete search history.

(56) References Cited

U.S. PATENT DOCUMENTS

| | | | | |
|---|---|---|---|---|
| 4,712,761 | A * | 12/1987 | Wassell | A47G 1/1606 248/220.1 |
| 6,279,257 | B1 * | 8/2001 | Lemire | A47G 1/0655 248/476 |
| 6,962,016 | B1 * | 11/2005 | Meyer | A47G 1/0605 40/700 |
| 2001/0030273 | A1 * | 10/2001 | Veazey | A47F 5/0846 248/475.1 |
| 2010/0123052 | A1 * | 5/2010 | Cheng | F16M 13/02 248/121 |
| 2010/0321917 | A1 * | 12/2010 | Kim | H04N 9/12 361/829 |
| 2011/0019348 | A1 * | 1/2011 | Kludt | F16B 2/12 361/679.01 |
| 2011/0233346 | A1 * | 9/2011 | Schluter | F16M 11/041 248/65 |

(Continued)

*Primary Examiner* — Gary C Hoge
(74) *Attorney, Agent, or Firm* — Dorsey & Whitney LLP

(57) ABSTRACT

A wall-mounted modular display includes a support bracket, an alignment bracket, and a display. The support bracket includes one or more lateral support components. The support bracket also includes one or more longitudinal alignment features. The alignment bracket includes one or more vertical alignment features that corresponds to and aligns with a portion of one or more of the longitudinal alignment feature, such that the alignment of the support bracket and the alignment bracket forms a constant angular relationship between the support bracket and the alignment bracket. The display includes one or more display fasteners that correspond to the one or more lateral support components.

19 Claims, 6 Drawing Sheets

(56) References Cited

U.S. PATENT DOCUMENTS

2011/0315837 A1* 12/2011 Mitsuhashi ..... G09F 7/18
248/201
2012/0050137 A1* 3/2012 Hellenthal ..... F16M 13/02
345/1.3
2013/0188327 A1* 7/2013 Lee ..... G09F 9/3026
361/807
2015/0187241 A1* 7/2015 Hall ..... G09F 21/04
29/428

* cited by examiner

MODULAR DISPLAY

CROSS REFERENCE TO RELATED APPLICATION(S)

This application claims priority to provisional application Ser. No. 62/343,719, filed on May 31, 2016, the entire contents of which is herein incorporated by reference in its entirety.

TECHNICAL FIELD

Implementations relate to methods, systems, products, devices, and/or apparatus generally related to a wall-mounted modular display, and more particularly, implementations provide a wall-mounted modular display with brackets including corresponding alignment features that enable the modules of the display to be in a constant angular relationship relative to one another.

SUMMARY

Wall-mounted modular display systems include brackets with corresponding alignment features that enable display modules to be in a constant angular relationship relative to one another.

In one implementation, a display mounting system includes a support bracket having a first support component, a second support component, a first alignment feature and a second alignment feature; an alignment bracket having a first alignment feature that corresponds to and aligns with a portion of the support bracket first alignment feature such that the alignment of the support bracket and the alignment bracket creates a fixed angular relationship between the support bracket and the alignment bracket; and a display having a first display fastener that corresponds to and engages the first support component.

In another implementation, a vertical wall bracketing system for hanging a matrix of displays includes a horizontal support bracket having a first support component, a first alignment feature having a plurality of alignment components, and second alignment feature having a plurality of alignment components, each alignment component including a first aperture extending through the horizontal support bracket and at least one additional aperture adjacent to the first aperture; and a vertical alignment bracket having a first alignment feature that includes a fastening stud which passes through the first aperture and a dimple which engages the second aperture, wherein the vertical alignment bracket and the support bracket engage with one another forming a fixed angular relationship therebetween.

In various implementations and alternatives, additionally provided is a second support bracket having a support component, where the display further comprises a second display fastener. The first support component engages the first display fastener proximal to a first edge of the display and the support component of the second support bracket supports the display proximal to an opposite edge of the display.

In such implementations, a second alignment bracket may have a second alignment feature that corresponds to and aligns with a portion of the support bracket second alignment feature. In addition or alternatively, the support bracket first alignment feature and the support bracket second alignment feature are located proximal to different longitudinal ends of the first support bracket. In addition or alternatively, a second display may be positioned adjacent to the first display. In addition or alternatively, the second support bracket and/or the second alignment bracket overlaps between the first display and the second display. In addition or alternatively, a third display positioned below the first display, and the second display is positioned horizontally on the side of the first display. In such implementations or alternatives, the second support bracket may overlap between the first display and the third display and the second alignment bracket may overlap between the first display and the second display.

In various implementations and alternatives, support bracket is substantially horizontal and/or the alignment bracket is substantially vertical.

In various implementations and alternatives, the support bracket first alignment feature includes an inner alignment component and an outer alignment component having a first distance from a center of the inner alignment component to a center of the outer alignment component. In such implementations or alternatives, the center of the outer alignment component is positioned a second distance measured from a first end of the first bracket to the center of the outer alignment feature, with the second distance being approximately half the first distance, and/or the inner alignment component and the outer alignment component each include at least one dimple and a stud, and/or the alignment bracket first alignment feature includes two alignment components substantially positioned on the same horizontal line as one another and spaced such that the two alignment components are configured to engage the inner and outer alignment features at the same time, and/or the alignment bracket overlaps the first display and a second display with one of the two alignment components engaging the outer alignment component and the other alignment component engaging an outer alignment component on a second support bracket.

In various implementations and alternatives, the support bracket first alignment feature includes an upper alignment component and a lower alignment component. In such implementations or alternatives, the support bracket overlaps between the first display and a second display, with a seam separating the first display and the second display passing between the upper alignment component and the lower alignment component.

In various implementations and alternatives, the first support component is defined by an elongated channel configured to engage with the first display attachment feature.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several examples in accordance with the disclosure and are, therefore, not to be considered limiting of its scope, the disclosure will be described with additional specificity and detail through use of the accompanying drawings, in which:

DETAILED DESCRIPTION

Figure 1A:
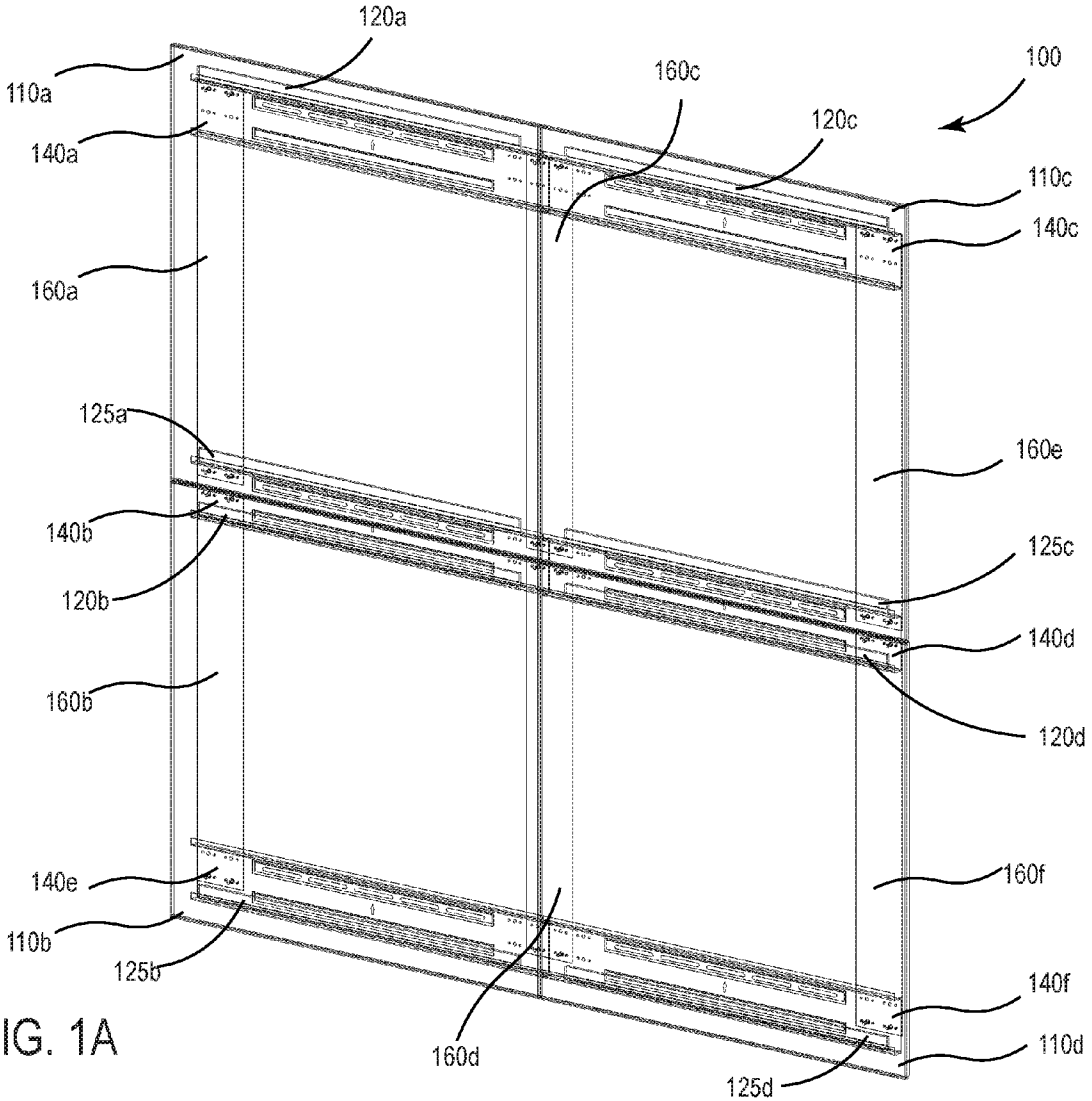
FIG. 1A is a perspective wireframe line view of a modular display having a plurality of displays.

In the following detailed description, reference is made to the accompanying drawings, which form a part hereof. In the drawings, similar symbols typically identify similar components, unless context dictates otherwise. The illustrative examples described in the detailed description, drawings, and claims are not meant to be limiting. Other examples may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are implicitly contemplated herein.

This disclosure is drawn, inter alia, to methods, systems, products, devices, and/or apparatus generally related to a wall-mounted modular display. The modular display includes a support bracket, an alignment bracket, and a display. The support bracket includes one or more lateral support components. The support bracket also includes one or more longitudinal alignment features. The alignment bracket includes one or more vertical alignment features that corresponds to and aligns with a portion of one or more of the longitudinal alignment feature, such that the alignment of the support bracket and the alignment bracket forms a constant angular relationship between the support bracket and the alignment bracket. The display includes one or more display fasteners that correspond to the one or more lateral support components.

FIG. 1A illustrates a modular display 100 having a plurality of displays 110*a-d* in accordance with one embodiment. The modular display 100 includes one or more displays (e.g. 110*a*). The display 110*a* is supported by at least a support bracket 140*a* and an alignment bracket 160*a*. The display 110*a* is associated with the support bracket 140*a* either directly or indirectly. For example, the display 110*a* includes a display fastener 120*a* that connects directly to a corresponding feature of the support bracket 140*a* to support the display 110*a* thereon.

Figure 1B:
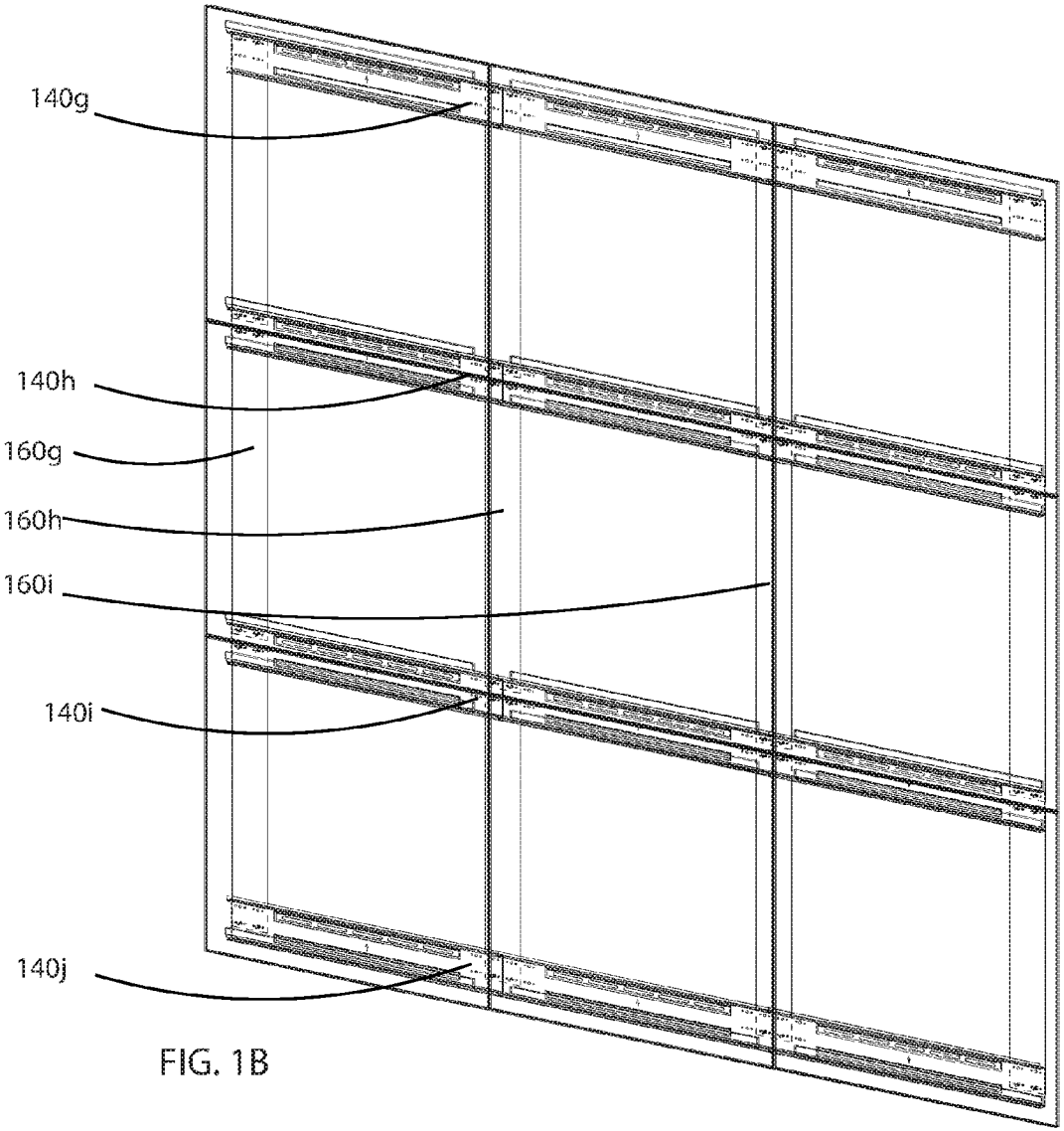
FIG. 1B is a perspective wireframe line view of a modular display having a plurality of displays.

The modular display 100 is expandable from a single display 110*a* to any number of displays only constrained by wall length and height. FIG. 1A illustrates a 2×2 array of displays as an example of the expansion from a single display 110*a* to multiple displays including display 110*a*, 110*b*, 110*c*, and 110*d*. Is should be appreciated that the structure, features, and methods provided herein allow a person of ordinary skill in the art to expand the system to any size array. For example, FIG. 1B illustrates a 3×3 array.

In accordance with various embodiments, the display 110*a* (or additional displays e.g. 110*b*-110*d*) are not connected directly to the wall providing support to the modular display 100. Instead, the display 110*a* is mounted to one or more brackets that are mounted to the wall. For example, the display 110*a* is mounted on support bracket 140*a* via the display fastener 120*a*. Additional support brackets (e.g. 140*b*-140*f*) may be added to expand the system. The support brackets (e.g. 140*a*-140*f*) are positioned relative to one another to provide the desired placement of the displays (e.g. 110*a*-110*d*) relative to one another on the wall. It should be appreciated that in other embodiments, the displays may have some features that allow direct attachment to the wall.

The expandability of the modular display 100 is provided by the interaction between the support brackets (e.g. 140*a-f*) and the alignment brackets (e.g. 160*a*-160*f*). In accordance with various embodiments, one of the brackets (e.g. the support bracket or the alignment bracket) is a substantially vertical bracket and the other bracket is a substantially horizontal bracket forming a perpendicular angle between the brackets. In other embodiments, the brackets can have other relative positions with respect to one another forming any relative angle between the different brackets. However, for the simplicity of illustration, FIG. 1A is shown with a substantially perpendicular angle between the brackets. The relationship between the different brackets can be maintained by providing corresponding alignment features between the brackets discussed in more detail below. In accordance with various embodiments, the support bracket (e.g. 140*a*) extends between two alignment brackets (e.g. 160*a* and 160*c*). Corresponding alignment features can be located on each end of the support bracket where the support bracket and the two alignment brackets meet. In a single display, the support bracket 140*a* would be positioned entirely within the circumference of the display 110*a* so that the display 110*a* covers the support bracket 140*a* and the alignment brackets 160*a* and 160*c*. In a multiple horizontal display (e.g. a 1×2 array), the alignment between support bracket 140*a* and one or more of the two alignment brackets (e.g. 160*a* and 160*c*) positions one or more of the alignment brackets in an overlapping position. For example, the alignment bracket 160*c* overlaps between displays 110*a* and 110*c* as shown by in FIG. 1A. In a multiple vertical display (e.g. a 2×1 array), the alignment between multiple support brackets (e.g. 140*a* and 140*b*) and two alignment brackets (e.g. 160*a* and 160*c*) positions one or more of the support brackets in an overlapping position across two displays (e.g. 110*a* and 110*b*). For example, the support bracket 140*b* overlaps between displays 110*a* and 110*b* as shown by in FIG. 1A. In a multiple vertical and horizontal display (e.g. a 2×2 array), the alignment between multiple support brackets (e.g. 140*a* and 140*b*) and multiple alignment brackets (e.g. 160*a* and 160*c*) positions one or more of the support brackets and one or more of the alignment brackets in an overlapping position across multiple displays (e.g. 110*a* and 110*b*) and (110*a* and 110*c*). For example, the support bracket 140*b* overlaps between displays 110*a* and 110*b* and the alignment bracket 160*c* overlaps between displays 110*a* and 110*c* as shown by in FIG. 1. This pattern can continue as the array expands. For example, as shown in FIG. 1A, alignment brackets 160*d* also overlaps between displays 110*b* and 110*d*. Also shown, support bracket 140*d* overlaps between displays 110*c* and 110*d*.

In accordance with various embodiments, to maintain aesthetic appeal, the brackets at the ends of the arrays do not extend outside of the display but are instead covered by the display. For example, alignment brackets 160*a*, 160*b*, 160*e*, and 160*f* are covered by the displays in the 2×2 array shown such that none of the alignment brackets extend beyond the outside of the displays. Also, in this example, support brackets 140*a*, 140*c*, 140*e*, and 140*f* are covered by the displays in the 2×2 array shown such that none of the support brackets extend beyond the outside of the displays. FIG. 1B illustrates a 3×3 array. In such an embodiment longer alignment brackets (as compared to alignment brackets at the top potion and bottom portions of the display system) may be used on intermediate displays such as alignment brackets 160*g*, 160*h*, and 160*i*. These longer brackets may allow the illustrated support brackets to overlap between vertically arranged display panels. The support brackets may also overlap across horizontal panels. For example, support brackets 140*g*, 140*h*, 140*i*, and 140*g* may overlap between adjacent horizontal panels having the respective alignment brackets inboard of the perimeter of the display at these locations.

FIGS. 2A-2D illustrates a display 110 in accordance with various embodiments. The display 110 illustrated in FIGS. 2A-2D corresponds to the displays 110*a-d* illustrated in FIG. 1A. Display 110 is configured for mounting on a wall in order to communicate information either passively or interactively. The display can convey information graphically, audibly, through tactile means and/or through any other type of system for communicating information. The display can be a television, monitor, bulletin board, white board, chalk board, poster, millwork, decorative panels, or the like. In accordance with one embodiment, the display 110 is a clear or translucent envelope suitable for holding replaceable graphics material such as paper or board stock.

Figure 2A:
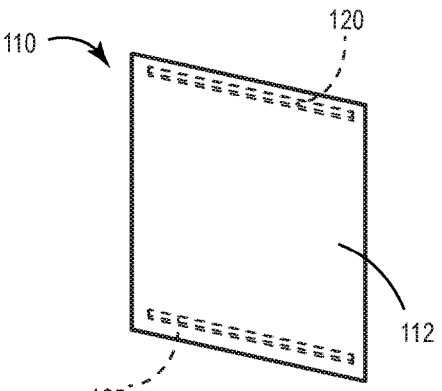
FIGS. 2A-2D are perspective, front, side and detail views respectively of a graphics display.

As illustrated in FIG. 2A the display 110 can include a front surface 112 suitable to view graphics material through or on. The display 110 can be any shape suitable to communicate the intended message. As the display system is modular each separate display 110 can provide a portion of the information to be conveyed, e.g., advertisement. Then when coupled with other display 110 units in an assembly, the remainder of the information to be conveyed, e.g., advertisement, may be completed. As indicated above, the display may be an envelope suitable to hold a graphics material. In this embodiment, one side of the display 110 may have an opening 118 defined by the front wall 112, the back wall 114, and side walls (shown as 116 in FIG. 2D). The opening 118 may be sufficiently large to slide a graphics material between the front wall and the rear wall. The display 110 may be made from metal, wood, polymer, silicone, or another similar suitable material. In one example, the envelope may be made from a polycarbonate or polystyrene material.

Figure 2D:
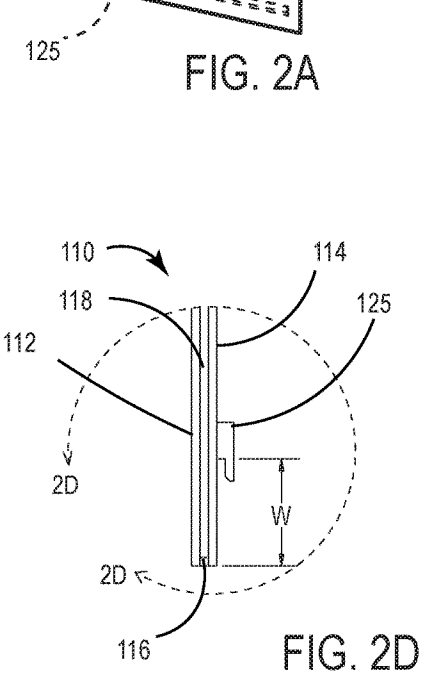
Figure 2C:
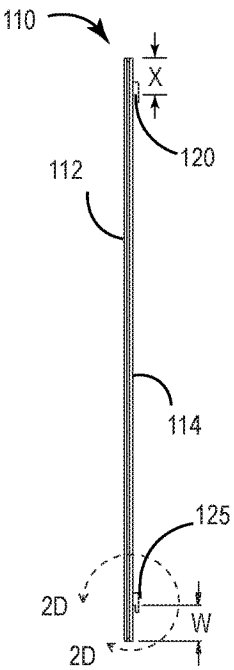

As illustrated in each of FIGS. 2A-2D, the display 110 includes a display fastener (e.g. 120 and 125). The display fasteners 120 and 125 correspond to the fasteners 120*a-d* and 125*a-d* illustrated in FIG. 1A. Each display 110 may be supported by a single display fastener located anywhere along the back of the display 114 (See FIGS. 2C and 2D). In accordance with the example shown, the display may include two fasteners, an upper fastener 120 and a lower fastener 125. The upper fastener 120 may be spaced a distance X from the top of the display 110 as shown in FIG. 2C. The lower fastener 125 may be spaced a distance W from the bottom of the display 110 as shown in FIGS. 2C and 2D.

Figure 2B:
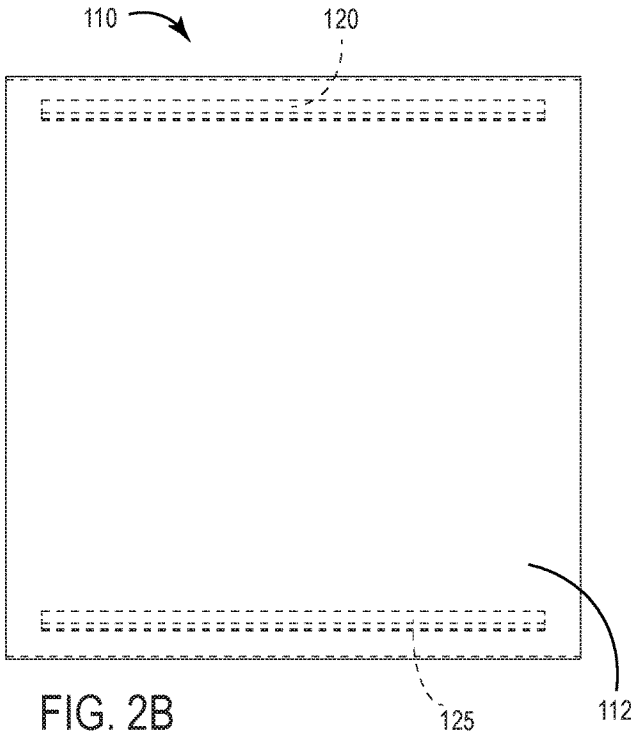
Figure 3A:
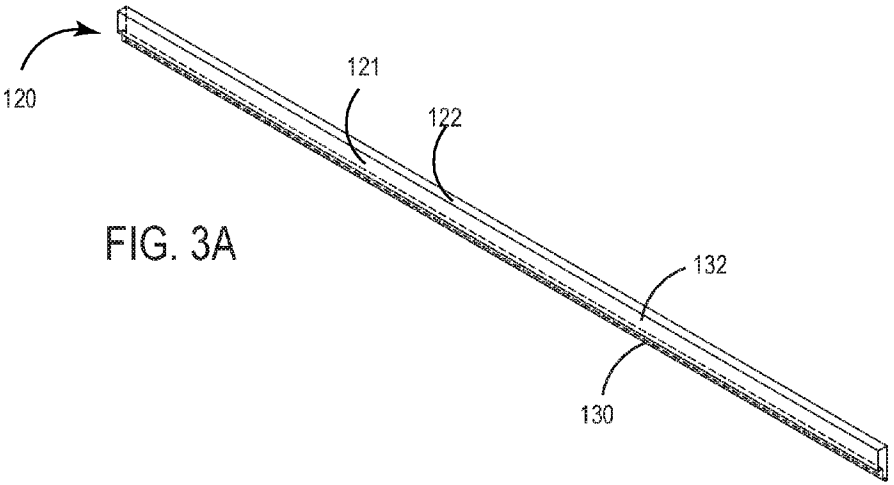
FIGS. 3A-3C are perspective, front and side views respectively of a graphic display fastener.
Figure 3B:
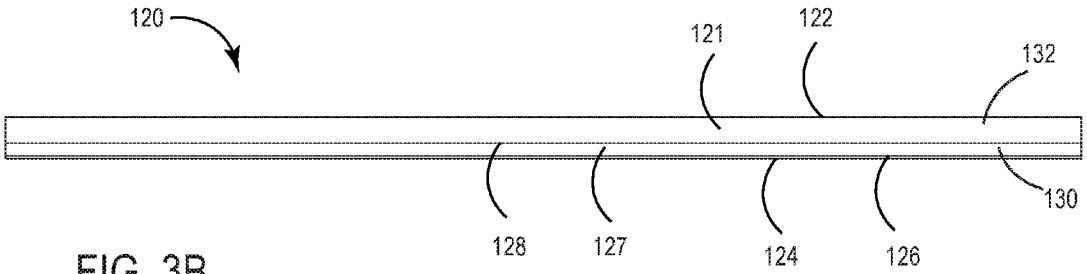
Figure 3C:
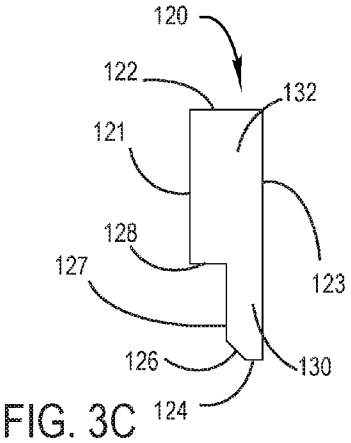

FIGS. 3A-3C illustrate a display fastener 120 in accordance with one embodiment. As illustrated, the display fastener 120 is an example of the display fasteners 120 and 125 illustrated in FIGS. 2A-2D as well as display fasteners 120*a-d* and display fasteners 125*a-d* illustrated in FIG. 1A. The display fastener 120 is suitable to connect or support the display 110 on a bracket (such as bracket 140 or bracket 160 discussed in more detail below). In various embodiments, the display fastener 120 is a corresponding fastener meaning that the structure of the display fastener 120 specifically corresponds to a mating structure of the bracket.

In accordance with one embodiment, the display fastener 120 is configured as a cleat that fixes to the back of the display 110 longitudinally (left to right as shown in FIG. 2B). The cleat (e.g. 120) includes a mounting portion 132 having a mating surface 121, a top surface 122, an outer surface 123, and a bottom surface 128. A protrusion 130 extends from the mounting portion 132. The protrusion 130 may be sized to specifically correspond to and fit within a receiving trough on the bracket. The protrusion 130 may extend from the bottom surface 128. The protrusion 130 may include a mating surface 127 and a bottom surface 124. In various embodiments the protrusion 130 includes an outer surface. In one example the outer surface is a different surface than the surface 123, but in other examples surface 123 contiguously forms the outer surface for both the mounting portion 132 and the protrusion. The mating surface 127 may be connected to the bottom surface 124 via a chamfer 126 suitable to guide the protrusion into a corresponding pocket when assembling the display 110 onto a bracket.

The bottom surface 128 may have a sufficient depth, as shown in FIG. 3C extending between surface 121 and 127, to accommodate a lip or wall of the bracket with which it mates. The chamfer 126 may ease the assembly of the protrusion past the wall or lip of the bracket. The mating surface 121 may conform to the back surface of the display 110. In the examples of FIGS. 1 and 2A-D, the display 110 is flat and therefore the mating surface 121 is correspondingly flat. The mating surface 121 may be fastened to the display 110 using either a mechanical or chemical fastener. In one example, the mating surface 121 is fastened to the back of the display 110 via an adhesive.

Figure 4A:
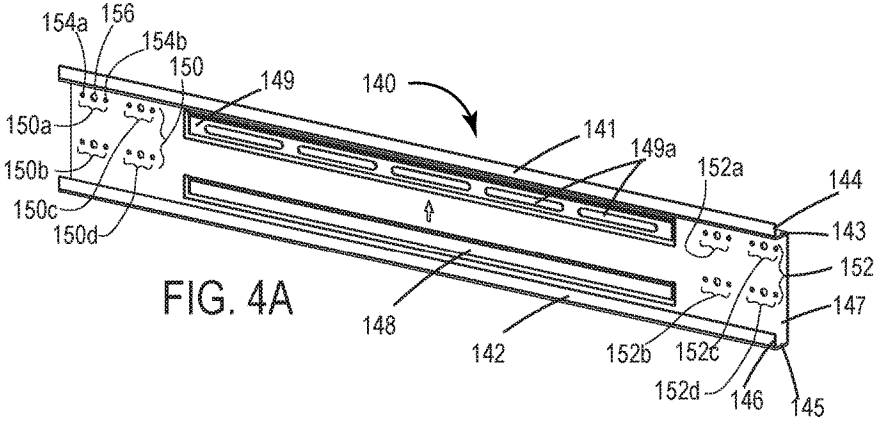
FIGS. 4A-4D are perspective, bottom, front, and side views respectively of a support bracket.
Figure 4B:
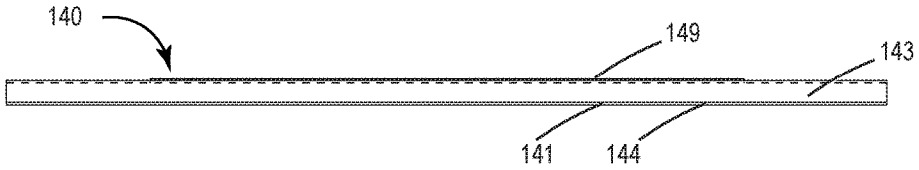
Figure 4C:
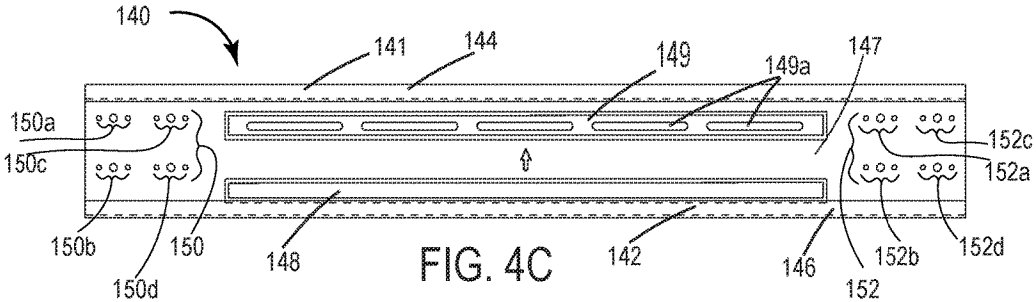
Figure 4D:
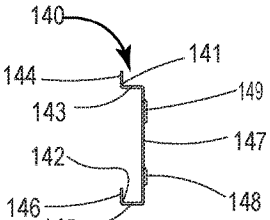
Figure 5A:
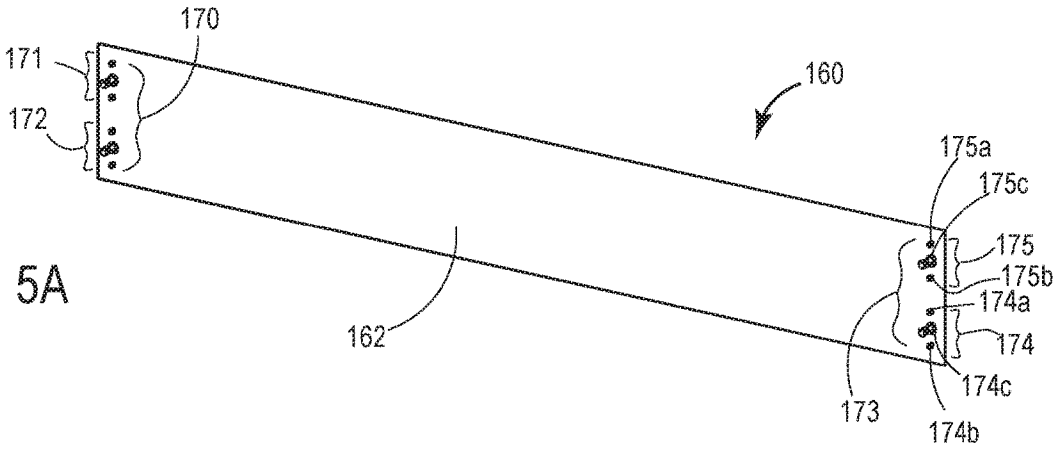
FIGS. 5A-5C are perspective, front and side views respectively of an alignment bracket; all arranged in accordance with at least some embodiments of the present disclosure.
Figure 5B:
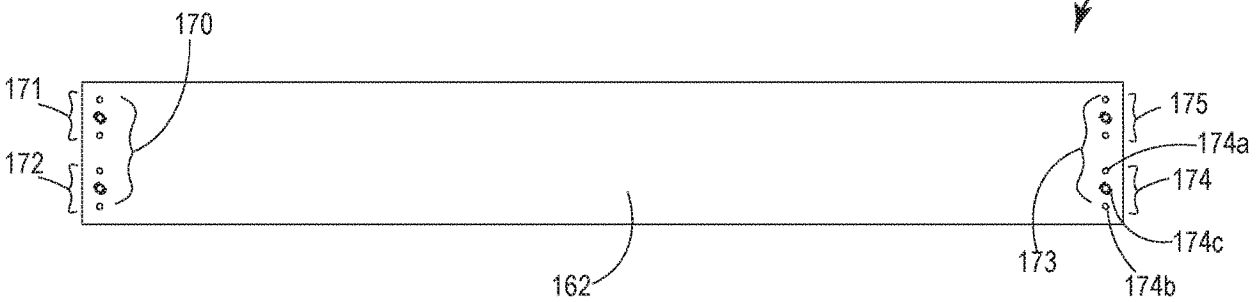
Figure 5C:
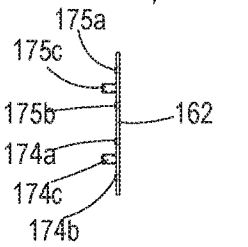

FIGS. 4A-4D illustrate a support bracket 140 in accordance with various embodiments. FIGS. 5A-5C illustrates an alignment bracket 160. The support bracket 140 and the alignment bracket 160 cooperate to mount display 110 to a structural support wall. The support bracket 140 includes one or more lateral support components. For example, the support bracket 140 can include an upper lateral support component 141 and a lower lateral support component 142. Although in other examples, it is appreciated that more of fewer lateral support components may be utilized. One or more of the lateral support components (e.g. 141, 142) may be connected to a mounting wall 147. In examples having multiple lateral support components, the lateral support components 141 and 142 may be connected to one another via mounting wall 147. The lateral support components 141, 142 may be suitable for engaging and supporting the display 110 via the display fastener 120. For example, the lateral support components 141, 142 may each define or partially define a channel or return suitable to receive and retain the cleat protrusion 130 described herein and illustrated in FIGS. 3A-3C. In accordance with one embodiment, the lateral support component 141 is defined by a support wall 143 that extends out or laterally from wall 147. The support wall 143 may include a protrusion, lip, or a retainer wall 144 extending upwardly from the support wall. When the bracket 140 is fastened to the alignment bracket 160 as shown in FIG. 1A, the lateral support component 141 defines a channel via the retainer wall 144 and the alignment bracket 160 with the support wall 143 forming the bottom, and the lateral support component 142 defines a channel via the retainer wall 146 and the mounting wall 147 with the support wall 145 forming the bottom. As illustrated in the example of FIG. 4D, the support wall 143 extends laterally from the top of the mounting wall 147 and the retainer wall 144 extends vertically above the support wall 143 and the mounting wall 147, so in the assembled state of the modular display system the channel is formed between the retainer wall 144 and the alignment bracket 160.

As described herein, in some embodiments the bracket 140 includes a second lateral support component 142. The second lateral support component 142 may be a lower component positioned proximal to one end of the bracket 140 which is opposite from a second end carrying the upper lateral support component 141. The lower lateral support component 142 may have a structure similar to or the same as the upper lateral support component 141. In other embodiments, the lower lateral support component 142 has a different structure from the upper lateral support component 141. As illustrated in the example of FIGS. 4A, 4C, and 4D, the structures are similar. In this example, the support component 142 is defined by a support wall 145 extending from mounting wall 147. A retainer wall 146 extends upwardly from the support wall 145. The distance between the retainer wall 146 and the mounting wall 147 may be slightly larger than the thickness of the display fastener engaging portion (e.g. protrusion 130) such that a secure fit between the two can be established.

As illustrated in FIGS. 4A-4D and in accordance with various embodiments, the mounting wall 147 includes at least one standoff 149. The standoff 149 extends from the backside of the bracket 140 (i.e. the side opposite on which the display 110 mounts). The standoff extends a distance proximately equal to the thickness of the alignment bracket 160. In various examples the standoff 149 is positioned proximal to the center line of the bracket 140 between the two longitudinal ends. In various examples, the standoff 149 extends more than half the longitudinal length of the bracket 140. In various examples, the standoff 149 has a length that is less than the length of the bracket 140, i.e. the standoff 149 does not extend from end to the other. In a particular example, the standoff 149 has a length that is less than the length of the bracket minus two times the width of the alignment bracket 160. In this way, an alignment bracket 160 is positionable on each end of bracket 140 without contacting the standoff. This structure allows the bracket 140 to sit flush against a structural support wall between two alignment brackets, while the ends of the bracket 140 can be positioned in front of the alignment brackets 160 on either end, with the alignment brackets 160 flush against the structural support wall. In various embodiments, the bracket 140 includes a second standoff 148. In such an embodiment, the standoff 148 can be proximal to one lateral edge (e.g. the lower edge) of the bracket while the standoff 149 is proximal to the other lateral edge (e.g. the upper edge).

In various embodiments, one or both of the standoffs 148, 149 can include apertures (e.g. 149*a-b*). The apertures may be elongated slots formed within the standoff. The elongated slots allow fasteners to pass though the bracket 140 such that the bracket 140 can be fastened, e.g., hung, on a structural support wall. By providing a significant portion of the length of the standoff with apertures, an installer can easily find a stud on a structural support wall to suspend the bracket therefrom.

As illustrated in FIGS. 4A and 4C, the support bracket 140 can include alignment features suitable to align the support bracket 140 in a predefined relationship with the alignment bracket 160, and more specifically, alignment features of the alignment bracket 160, which may enable the support bracket and the alignment bracket to establish a constant angular relationship between one another. For instance, the support bracket 140 may be arranged at a 90-degree angle relative to the alignment bracket 160 upon engagement of corresponding alignment features.

Referring to FIGS. 4A and 4C, one longitudinal end of support bracket 140 can include an alignment feature 150. The alignment feature 150 is configured to engage with one or more alignment features on the alignment bracket 160. This engagement between the support bracket 140 and the alignment bracket 160 allows for precise angular, vertical, and horizontal control of the support bracket relative to the alignment bracket 160. In some embodiments each longitudinal end of the support bracket 140 can include an alignment feature. As illustrated in FIG. 4C, one alignment feature 150 is on a first end and a second alignment feature 152 is on the opposite end.

As illustrated in FIGS. 5A-5C, the alignment bracket 160 includes and alignment member 162. In one example, the alignment member 162 is a plate. The alignment bracket 160 also includes at least one alignment feature 170 positioned on the bracket. In one example, there are two alignment features e.g., 170 and 173. One alignment feature 170 is proximal to one end of the alignment bracket 160 and the other alignment feature 173 is proximal to the opposite end of the bracket 160. One or more of the alignment features 170, 173 may be configured to engage with alignment features on the support bracket 140. In accordance with various embodiments, the engagement between alignment features on the alignment bracket 160 and the alignment features on the support bracket 140 causes the two brackets to lock in a particular angular relationship to one another. For example, the alignment features may cause the two brackets to lock into a perpendicular relationship with one another.

In one example, the alignment features 170, 173 include one or more of a set of protrusions (e.g. a first set 175*a*, 175*b*, 175*c* and a second set 174*a*, 174*b*, 174*c*). The protrusions may be suitable to engage with corresponding alignment features 150, 152 of the support bracket 140. For example, the corresponding alignment features 150, 152 include one or more of a set of receiving features (e.g. 154*a*, 154*b*, 156) such as a set of apertures. The apertures can be open or closed so long as they are suitable to receive the alignment features 170, 173 from the alignment bracket. In one example the set of protrusions (e.g. 175*a*, 175*b*, 175*c*) include dimples 175*a*, 175*b* positioned on either side of a stud 175*c*, such as a threaded stud. The set of receiving features (e.g. 154*a*, 154*b*, 156) includes an open aperture between two other apertures that can be either open or closed. The open aperture (e.g. 156) allows the stud 175*c* to pass through the support bracket 140. A nut can be threaded onto the stud 175*c* thereby securely fastening the support bracket 140 to the alignment bracket 160. The other apertures (e.g. 154*a* and 154*b*) are located on either side of the open aperture 156 and these apertures 154*a*, 154*b* engage the dimples 175*a*, 175*b*. Thus the interaction between the stud 175*c* and the aperture 156 fastens the brackets together and the interaction between the dimples 175*a*, 175*b* and the apertures 154*a*, and 154*b* limit or prevent angular rotation or adjustment between the support bracket 140 and the alignment bracket 160.

In accordance with various embodiments, the alignment feature 150 of the support bracket 140 includes a plurality of alignment features. For example, the alignment feature 150 includes a row of alignment components including 150*a* and 150*c*. In some embodiments, the alignment feature 150 also includes a second row of alignment components 150*b* and 150*d*. Each of these alignment components 150*a*, 150*b*, 150*c*, and 150*d* may include and be structured as discussed above with receiving features 154*a*, 154*b*, and 156. In accordance with various embodiments, alignment feature 152 includes a plurality of alignment components. For example, the alignment feature 152 includes a row of alignment components including 152*a* and 152*c*. In some embodiments, the alignment feature 152 also includes a second row of alignment components 152*b* and 152*d*. Each of these alignment components 152*a*, 152*b*, 152*c*, and 152*d* may include and be structured like apertures 154*a*, 154*b*, and 156.

In accordance with various embodiments, alignment feature 170 of the alignment bracket 160 includes a plurality of alignment components. For example, the alignment feature 170 includes a row of alignment components including 171 and 172. Each of these alignment components 171, 172 may include and be structured as described herein in connection with protrusion features as 175*a*, 175*b*, and 175*c*. In accordance with various embodiments, alignment feature 173 includes a plurality of alignment components. For example, the alignment feature 173 includes a row of alignment components including 174 and 175. Each of these alignment components 174, 175 may include and be structured as described herein in connection with protrusion features 175*a*, 175*b*, and 175*c* as respectively shown in FIG. 5A.

Alignment components 171, 172 and 174, 175 may be sized corresponding with any one or more of the alignment features on the support bracket 140. For example, alignment components 171, 172 may engage with any pair of components 150*a*, 150*c*, or 150*b*, 150*d*, or 152*a*, 152*c*, or 152*b*, 152*d*. Similarly, alignment components 174, 175 may engage with any pair of components 150*a*, 150*c*, or 150*b*, 150*d*, or 152*a*, 152*c*, or 152*b*, 152*d*. In this way, the alignment bracket 160 may engage with the support bracket 140 fully inboard within either edge of the support bracket 140. In some situations it is desirable to align a first support bracket 140*a* next to a second support bracket 140*c* as shown in FIG. 1A. In such a situation the alignment bracket 160 can overlap between the support brackets. As such, the distances from the center of the outer alignment components (e.g. 150*a*, 150*b*, 152*c*, 152*d*) on a support bracket 140 to the adjacent edge of the support bracket 140 is equal to one-half the distance from the center of one alignment feature to an adjacent alignment feature (e.g. 150*a* to 150*c*, or 150*b* to 150*d*, or 152*a* to 152*c*, or 152*b* to 152*d*). Thus when two support brackets (e.g. 140*a* and 140*c*) are placed end-to-end, alignment features from each bracket are positioned such that the alignment bracket 160 and its alignment components (e.g. 171, 172 or 174, 175) can engage the two support brackets, such as with alignment bracket 160*c*.

The length of the alignment bracket 160 from alignment element 170 to alignment element 173 can set the spacing between different support brackets such as support bracket 140*a* and 140*b* shown in FIG. 1A.

By having two rows of alignment components as discussed above, a first alignment bracket (e.g. 160*a* shown in FIG. 1A) can engage one row of alignment components (e.g. 150*a*, 150*c*) of a support bracket (e.g., 140*b*) and a second alignment bracket (e.g. 160*b* shown in FIG. 1A) can engage the second row of alignment components (e.g. 150*b*, 150*d*) of the same support bracket (e.g. 140*b*). This relationship allows the display stem to be vertically modular with the support bracket operable to overlap between displays arranged vertically. To expand beyond two displays high, a longer alignment bracket 160 can be used on interior display panels where there is no issue with staying inboard of the panel peripheral.

The various components described in the various FIGS. 1-5 are merely examples, and other variations, including eliminating components, combining components, and substituting components are all contemplated.

In accordance with various embodiments, a display may be mounted to a structural support wall by locating at least one of an alignment bracket or a support bracket in its desired orientation. In one example, the alignment bracket may be oriented vertically at the desired height of the display. In another example, the support bracket may be oriented horizontally at the desired height of the display. The other bracket may then be aligned with the oriented bracket by engaging the corresponding alignment features between the two brackets. In one example, the alignment bracket may be positioned in a desired location and orientation on a support wall. The alignment bracket may be held in place by a mechanical fastener or an adhesive. The alignment features of the support bracket may then engage the alignment feature of the alignment bracket. The engagement between the alignment features may automatically position (e.g., clock) the support bracket at a desired angle relative to the alignment bracket. In this way, once the first bracket is placed, subsequent brackets will maintain that relative orientation so that squaring the entire display system is simplified. The installer may then locate a vertical stud and fasten the support bracket to the wall. A second support bracket may then be attached to the other set of alignment features on the alignment bracket. The spacing of the alignment features on the alignment bracket may correspond to the distance between two adjacent support brackets (e.g., upper and lower support brackets) that allows support components on the adjacent support brackets to correspond to and align with the upper and lower fasteners on the back of the display. On the opposite, non-attached side of the support brackets, a second alignment bracket may be installed by engaging the second alignment bracket with the second set of alignment features on the support brackets. Using the fasteners of the display, the display may then be mounted on the support components of the support brackets. In this way a single display panel (e.g., module) can be installed.

As previously provided herein, and in accordance with various embodiments, an array of display panels can be installed. The array may be expanded from the single panel (e.g., module) by overlapping the alignment feature across a seam between displays in the horizontal direction or by overlapping the support bracket across the seam between display panels in the vertical direction. In embodiments having an array extending both vertically and horizontally, the support brackets and the alignments brackets can overlap the seams between displays. The overlap is possible by aligning a portion of the alignment feature (e.g., an alignment component as discussed above) of one bracket (e.g., the alignment bracket) with two other brackets (e.g., two support brackets). This alignment of respective alignment components allows the array to stay square to the original placement of the first bracket because each alignment component clocks the brackets with respect to one another making assembly of the bracket system quick with minimal leveling or squaring of the brackets to the wall.

In some embodiments, using a first length of an alignment bracket may allow for keeping the support brackets inboard of the perimeter of a display which may be preferable when installing a single row of displays or allowing one support bracket (e.g., either the upper or the lower bracket) to extend beyond the perimeter for installing two rows of displays. Using a second length of the alignment bracket may allow for extending the support brackets outside of the perimeter on both sides of the display for use with installing three or more rows of displays. In other embodiments, different configurations of the support bracket may enable a single alignment bracket to be used for any size of array. Also, using various lengths or heights of brackets can also allow for use of different lengths or heights of displays. Further, the display may be configured to span horizontally across multiple support brackets or vertically along multiple alignment brackets. In this alternative, the display may include fasteners spaced apart such that the fasteners engage two or more support components of the underlying support brackets; and in some aspects, fasteners may be provided for engaging with each underlying support component, or for engaging with one support component of each underlying support bracket. Yet further, the display may be configured to engage a support component and span partially across a single support bracket to thereby enable a second display to engage with the same support component. In further implementations, the display may span partially across one support bracket and fully across another support bracket.

The present disclosure is not to be limited in terms of the particular examples described in this application, which are intended as illustrations of various aspects. Many modifications and examples can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and examples are intended to fall within the scope of the appended claims. The present disclosure is to be limited only by the terms of the appended claims, along with the full scope of equivalents to which such claims are entitled. It is also to be understood that the terminology used herein is for the purpose of describing particular examples only, and is not intended to be limiting.

The herein described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components.

While various aspects and examples have been disclosed herein, other aspects and examples will be apparent to those skilled in the art. The various aspects and examples disclosed herein are for purposes of illustration and are not intended to be limiting, with the true scope and spirit being indicated by the following claims.

What is claimed is:

1. A display mounting system comprising:

a support bracket defining a first support component, a second support component, a first alignment feature and a second alignment feature;

an alignment bracket having a first alignment feature that corresponds to and aligns with a portion of the support bracket first alignment feature such that the alignment of the support bracket and the alignment bracket creates a fixed angular relationship between the support bracket and the alignment bracket; and a first display and a second display with the first display having a first display fastener that corresponds to and engages the first support component, wherein at least one of the support bracket or the alignment bracket is extensive beyond an outer perimeter of the first display such that at least one of the support bracket or the alignment bracket overlaps between the first display and the second display.

2. The display mounting system of claim 1, further comprising a second support bracket having a support component and wherein the first display further comprises a second display fastener, wherein the first support component engages the first display fastener proximal to a first edge of the display and the support component of the second support bracket supports the display proximal to an opposite edge of the display.

3. The display mounting system of claim 2, further comprising a second alignment bracket having a second alignment feature that corresponds to and aligns with a portion of the support bracket second alignment feature.

4. The display mounting system of claim 3, wherein the support bracket first alignment feature and the support bracket second alignment feature are located proximal to different longitudinal ends of the support bracket.

5. The display mounting system of claim 3, wherein the second support bracket overlaps between the first display and the second display.

6. The display mounting system of claim 3, wherein the second alignment bracket overlaps between the first display and the second display.

7. The display mounting system of claim 3, further comprising a third display positioned below the first display, wherein the second display is positioned horizontally on the side of the first display.

8. The display mounting system of claim 7, wherein the second support bracket overlaps between the first display and the third display and the second alignment bracket overlaps between the first display and the second display.

9. The display mounting system of claim 1, wherein the support bracket is substantially horizontal.

10. The display mounting system of claim 1, wherein the alignment bracket is substantially vertical.

11. The display mounting system of claim 1, wherein the support bracket first alignment feature includes an inner alignment component and an outer alignment component having a first distance from a center of the inner alignment component to a center of the outer alignment component.

12. The display mounting system of claim 11, wherein the center of the outer alignment component is positioned a second distance measured from a first end of the first bracket to the center of the outer alignment feature, with the second distance being approximately half the first distance.

13. The display mounting system of claim 11, wherein the inner alignment component and the outer alignment component each include at least one dimple or a stud.

14. The display mounting system of claim 11, wherein the alignment bracket first alignment feature includes two alignment components substantially positioned on the same horizontal line as one another and spaced such that the two alignment components are configured to engage the inner and outer alignment features at the same time.

15. The display mounting system of claim 11, wherein the alignment bracket overlaps the first display and the second display with one of the two alignment components engaging the outer alignment component and the other alignment component engaging an outer alignment component on a second support bracket.

16. The display mounting system of claim 1, wherein the support bracket first alignment feature includes an upper alignment component and a lower alignment component.

17. The display mounting system of claim 16, wherein the support bracket overlaps between the first display and the second display, with a seam separating the first display and the second display passing between the upper alignment component and the lower alignment component.

18. The display mounting system of claim 1, wherein the first support component is defined by an elongated channel configured to engage with the first display fastener.

19. A vertical wall bracketing system for hanging a matrix of displays, the bracketing systems comprising:

a horizontal support bracket having a first support component, a first alignment feature having a plurality of alignment components, and second alignment feature having a plurality of alignment components, each alignment component including a first aperture extending through the horizontal support bracket and at least one additional aperture adjacent to the first aperture; and a vertical alignment bracket having a first alignment feature that includes a fastening stud which passes through the first aperture and a dimple which engages the second aperture, wherein the vertical alignment bracket and the support bracket engage with one another forming a fixed angular relationship therebetween.

* * * * *